US008379002B2

(12) United States Patent
Kang et al.

(10) Patent No.: US 8,379,002 B2
(45) Date of Patent: Feb. 19, 2013

(54) DATA TRANSMITTING DEVICE AND FLAT PLATE DISPLAY USING THE SAME

(75) Inventors: Hyeong-Won Kang, Seoul (KR); Jin-Won Chung, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 390 days.

(21) Appl. No.: 12/845,245

(22) Filed: Jul. 28, 2010

(65) Prior Publication Data

US 2011/0157104 A1 Jun. 30, 2011

(30) Foreign Application Priority Data

Dec. 30, 2009 (KR) ..... 10-2009-0133954

(51) Int. Cl.
*G09G 5/00* (2006.01)
*G09G 3/36* (2006.01)

(52) U.S. Cl. ..... 345/204; 345/98

(58) Field of Classification Search ..... 345/98–100, 345/204, 211–213
See application file for complete search history.

(56) References Cited

U.S. PATENT DOCUMENTS

| | | | | |
|---|---|---|---|---|
| 5,859,669 | A * | 1/1999 | Prentice | 348/469 |
| 5,986,641 | A * | 11/1999 | Shimamoto | 345/593 |
| 6,480,180 | B1 * | 11/2002 | Moon | 345/98 |
| 2005/0068309 | A1 * | 3/2005 | Chang et al. | 345/204 |
| 2005/0088430 | A1 * | 4/2005 | Cheng et al. | 345/204 |
| 2009/0015537 | A1 * | 1/2009 | Park et al. | 345/99 |

* cited by examiner

*Primary Examiner* — Jimmy H Nguyen
(74) *Attorney, Agent, or Firm* — McKenna Long & Aldridge, LLP

(57) ABSTRACT

A data transmitting device and a flat plate display using the same are disclosed. The data transmitting device includes a clock generator to generate and output a first clock signal and to generate a plurality of second clocks signals having different phases; a serializer to convert parallel image data and a dot clock input at a slow speed to high speed serial data and high speed clock according to the first and second clocks outputted from the clock generator and to output the high speed serial image data and the high speed clock; and a signal converter to convert the serial image data and the high speed clock outputted from the serializer into differential signals and to output the differential signals.

13 Claims, 4 Drawing Sheets

DATA TRANSMITTING DEVICE AND FLAT PLATE DISPLAY USING THE SAME

CROSS REFERENCE TO RELATED APPLICATION

This application claims the benefit of the Patent Korean Application No. 10-2009-0133954, filed on Dec. 30, 2010, which is hereby incorporated by reference as if fully set forth herein.

BACKGROUND OF THE INVENTION

1. Field of the Invention

The present invention relates to a data transmitting device, more particularly, to a data transmitting device capable of converting clock frequency by using a serializer such as data in order to match data with clock, and a flat plate display using the same.

2. Discussion of the Related Art

A flat plate display capable of displaying images by using digital data may include a liquid crystal display (LCD) using liquid crystal, a plasma display panel (PDP) using discharge of inactive gas, an organic light emitting diode (OLED) using organic light emitting diodes and the like.

Because of a trend of high resolution and large size required to display a high quality image, the amount of data transmission of such the flat plate panel display device has been increasing. As a result, the transmission frequency of data is getting high and the number of data transmission lines is increased such that electromagnetic interference (hereinafter, EMI) may occur a lot. The problem of EMI is generated in digital interface between a timing controller and a data driver of the flat plate display and it causes unstable driving of the device. To solve the problem of EMI and to reduce power consumption when data is transmitted at a high speed, the flat plate display uses data transmission methods that transmit data by using low voltage differential signals, wherein the data transmission methods includes an LVDS (Low Voltage Differential Signal) transmission method, a Mini-SVDS transmission method and the like. The interface between the timing controller and the data driver of the flat plate display typically uses the mini-LVDS data transmission method.

For the mini-LVDS data transmission, the timing controller includes an LVDS transmitter mounted in an output terminal and the data driver includes an LVDS receiver mounted in an input terminal. The LVDS transmitter converts data and a clock signal into low voltage differential signals and outputs the low voltage differential signals. The LVDS receiver converts the low voltage differential signals into the data and the clock signal.

The LVDS transmitter converts parallel data into high speed serial data and then converts the high speed serial data along with the clock signal into the low voltage differential signals to output the low voltage differential signals.

To match a timing transmitting the data with a timing transmitting the clock signal, the LVDS transmitter of the related art adjusts a delay time of the clock signal using a plurality of delay logic chains and buffers, thereby compensating a timing of the clock signal to minimize a time skew between the data and the clock signal.

The LVDS transmitter adjusts the clock timing using the logic buffers which separate from the serializer converting the parallel data into the high speed serial data. Because of that, the clock timing independently change without operating together the data according to the power, voltage and temperature changes, thereby skewing the predetermined timing skew between the data and the clock. If it is skewed the timing skew between the data and the clock, it is occurred an error that the LVDS receiver cannot restore accurate data.

SUMMARY OF THE INVENTION

Accordingly, the present invention is directed to a data transmitting device and a flat plate display using the same.

An object of the present invention is to provide a data transmitting device capable of matching data with clocks by converting clock frequency via a serializer such as data, and a flat plate display using the data transmitting device.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a data transmitting device includes a clock generator configured to generate and output a first clock by using oscillation according to an input reference clock and to generate a plurality of second clocks having different phases, by multiplying frequency of the first clock and separating a phase of the multiplied first clock; a serializer configured to convert parallel image data and a dot clock inputted at a slow speed into high speed serial data and high speed clock according to the first and second clocks outputted from the clock generator and to output the high speed serial image data and the high speed clock; and a signal converter configured to convert the serial image data and the high speed clock outputted from the serializer into differential signals and to output the differential signals.

The serializer may include first to third serializers configured to convert the parallel image data into the serial image data by color unit according to the first and second clocks; and a fourth serializer configured to convert the dot-clock into the high speed clock according to the first and second clocks.

Each of the first to fourth serializers may include a plurality of first multiplexers configured to multiplex a n-bit input signal by m (n>m) bit unit in response to the first clock and to convert the n-bit input signal into a plurality of m-bit serial signals; and a second multiplexer configured to convert the plurality of the m-bit serial signals into n-bit serial signals, wherein each of the dot-clocks may be commonly inputted in the fourth serializer at each of bits of the n-bit input signals.

Each of the first to fourth serializers may further include a delayer configured to delay a timing of serial signals outputted from the second multiplexer.

The clock generator may include a phase locked loop (PLL) configured to generate and output the first clock having a higher speed than the reference clock according to oscillation using the input reference clock; and a ring counter configured to generate and output the plurality of the second clocks having a higher speed than the first clock by multiplying frequency of the first clock and separating a phase of the first clock.

The high speed clock may be synchronized with a middle area of the serial image data to be outputted.

In another aspect of the present invention, a flat plate display comprising, the flat plate display includes a timing controller including the data transmitting device to convert the image data and the dot-clock into the differential signals and to output the differential signals; and a data driver configured to receive the differential signals from the timing controller and to restore the image data and the dot-clock from the received differential signals to supply the restored image data and dot-clock to a display panel.

Here, the flat plate display may be a liquid crystal display.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

DESCRIPTION OF THE ILLUSTRATED EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
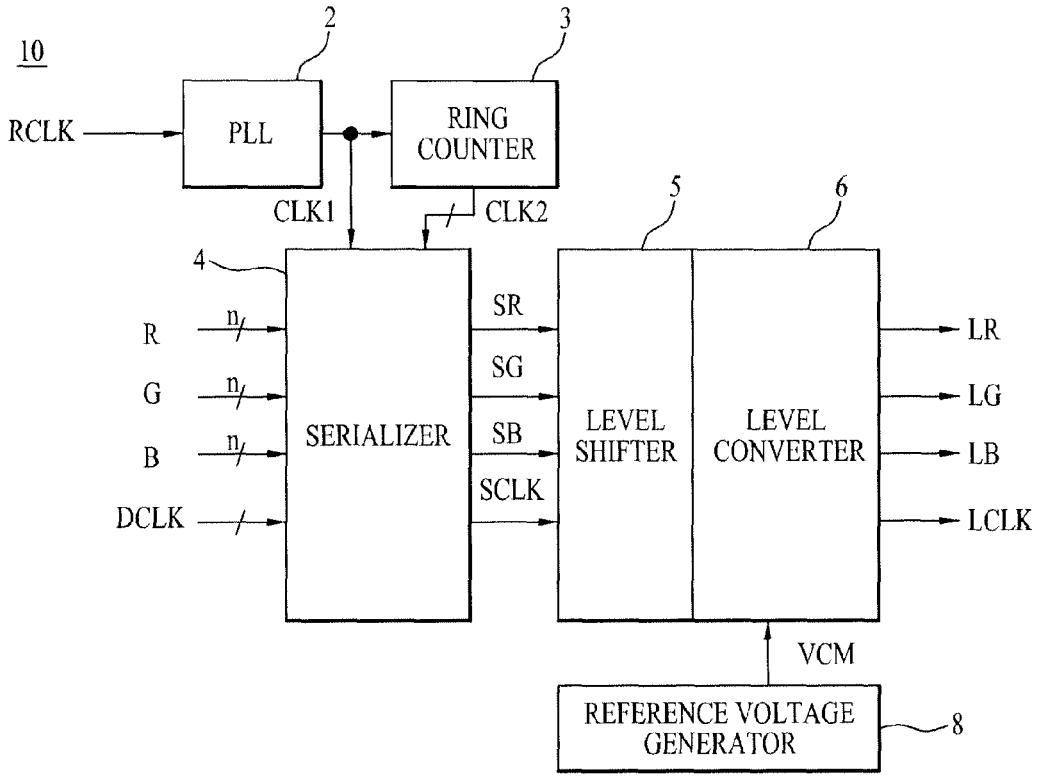
FIG. 1 is a diagram schematically illustrating a data transmitting device according to an exemplary embodiment of the present invention.

FIG. 1 is a block view schematically illustrating a LVDS transmitter of the data transmitting device using mini-LVDS according to an exemplary embodiment of the present invention.

The LVDS transmitter 10 shown in FIG. 1 includes a clock generator including a phase locked loop 2 (hereinafter, PLL) and a ring counter 3, a serializer 4, a level shifter 5, a LVDS converter 6 and a reference voltage generator 8.

The PLL 2 oscillates according to a reference clock (CLK) inputted at a low speed to generate a first clock (CLK1) and it outputs the generated first clock to the ring counter 3 and the sterilizer 4.

The ring counter 3 multiplies frequency of the first clock (CLK1) outputted from the PLL 2 and it separates a phase from the multiplied first clock (CLK1) to generate a second clock (CLK2) of high speed having phases shifted sequentially to output to the serializer 4. For example, in case the serializer 4 converts 6-bit parallel data into serial data, the ring counter 3 multiplies the frequency of the first clock (CLK1) three times and it shifts the phase of the first clock (CLK1) to generate and output three second clocks (CLK2) having difference phases.

The serializer 4 converts n-bit parallel data (R, G and B) inputted at the low speed and a dot-clock into a high speed serial data (SR, SG and SB) and a high speed clock (SCLK) by using the first and second clocks (CLK1 and CLK2) outputted from the PLL 2 and the ring counter 3 at a high speed, which are clock generators, to output. At this time, the dot-clock (DCLK) is converted into the high speed clock (SCLK) according to the first and second clocks (CLK1 and CLK2) via the identical serializer 4 like the image data (R, G and B) such that timing matching between the converted serial data (SR, SG and SB) and the high speed clock (SCLK) may be performed easily. In addition, even when a power, voltage and temperature are changed according to external environments and device difference, the timing of the serial data (SR, SG and SB) is changed at the same level of the timing of the high speed clock (SCLK). Because of that, a timing skew between the serial data (SR, SG and SB) and the high speed clock (SCLK) may be reduced as much as possible.

The level shifter 5 shifts voltage levels of the high speed serial data (SR, SG and SB) and the high speed clock (SCLK) to output to the LVDS converter 6.

The LVDS converter 6 converts each of the high speed serial data (SR, SG and SB) and the high speed clock (SCLK) outputted from the level shifter 5 into a mini-LVDS, that is, low voltage differential signal (LS, LG, LB and LCLK) and it outputs each of the low voltage differential signals (LR, LG, LB and LCLK) to a LVDS receiver (not shown) via a corresponding couple of transmission lines. The LVDS converter 6 uses a reference voltage (VCM) generated from the reference voltage generator 8 as reference voltage, that is, a center voltage, of each differential signal (LS, LG, LB and LCLK).

Figure 2:
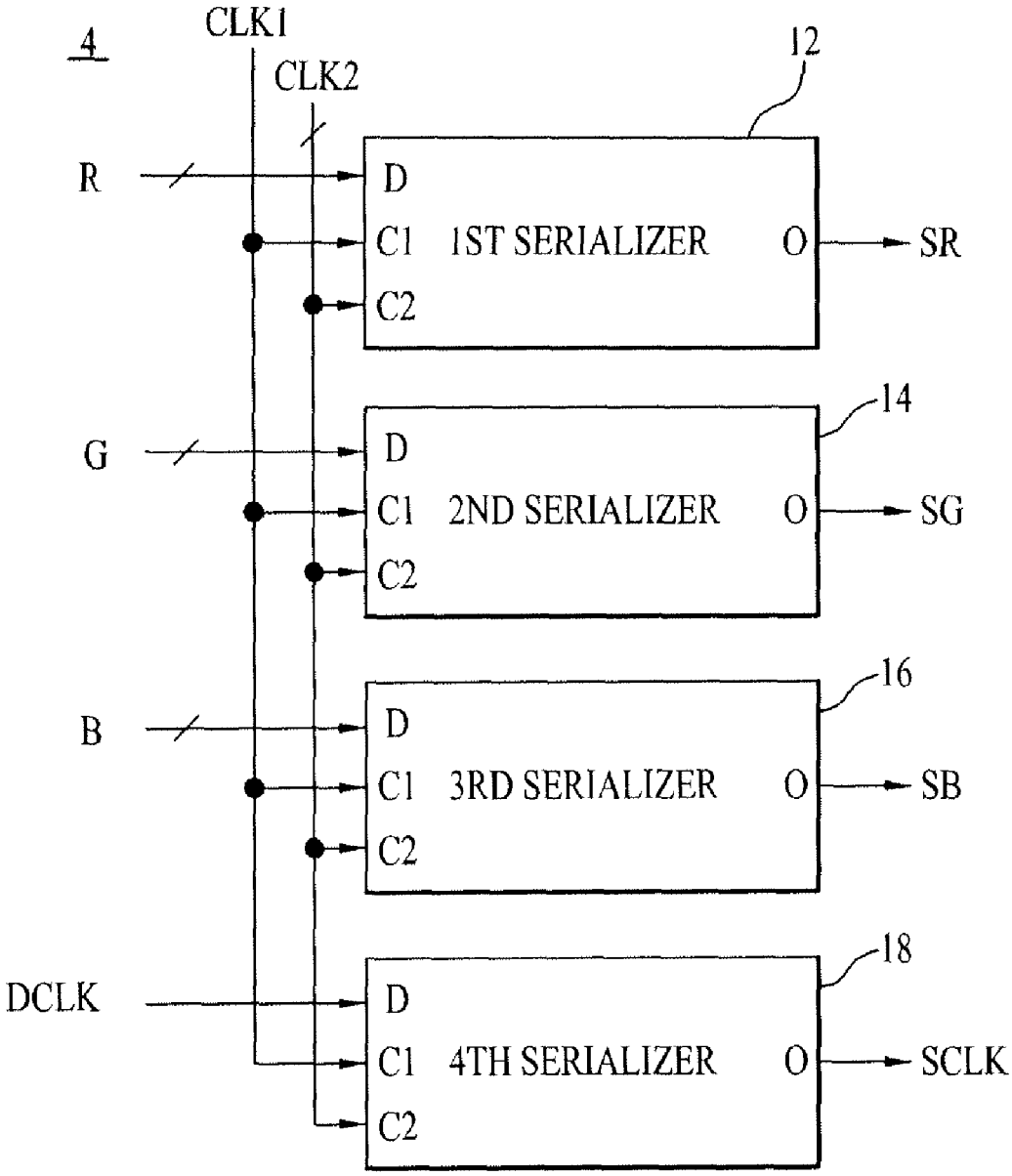
FIG. 2 is a block diagram illustrating an inner configuration of a serializer shown in FIG. 1.

FIG. 2 is a block diagram illustrating an inner configuration of the serializer 4 shown in FIG. 1.

The serializer 4 shown in FIG. 2 includes first to fourth serializers 12, 14, 16 and 18.

The first to third serializers 4 converts the three color parallel data (R, G and B) inputted at the low speed into the serial data (SR, SG and SB) by using the first clock (CLK1) outputted from the PLL 2 and the second clock (CLK2) outputted from the ring counter 3, respectively, to output. For example, in case of input 6-bit parallel data, the first to third serializers 12, 14 and 16 convert the 6-bit parallel data into three 2-bit serial data having increased frequency in response to the first clock (CLK1) outputted from the PLL2 and convert the three 2-bit serial data into 6-bit serial data in response to the second clock (CLK2) outputted from the ring counter 3.

Using this method, the fourth serializer 18 also converts the dot-clock (DCLK) inputted at the low speed into the high speed clock (SCLK) by suing the first and second clocks (CLK1 and CLK2).

Figure 3:
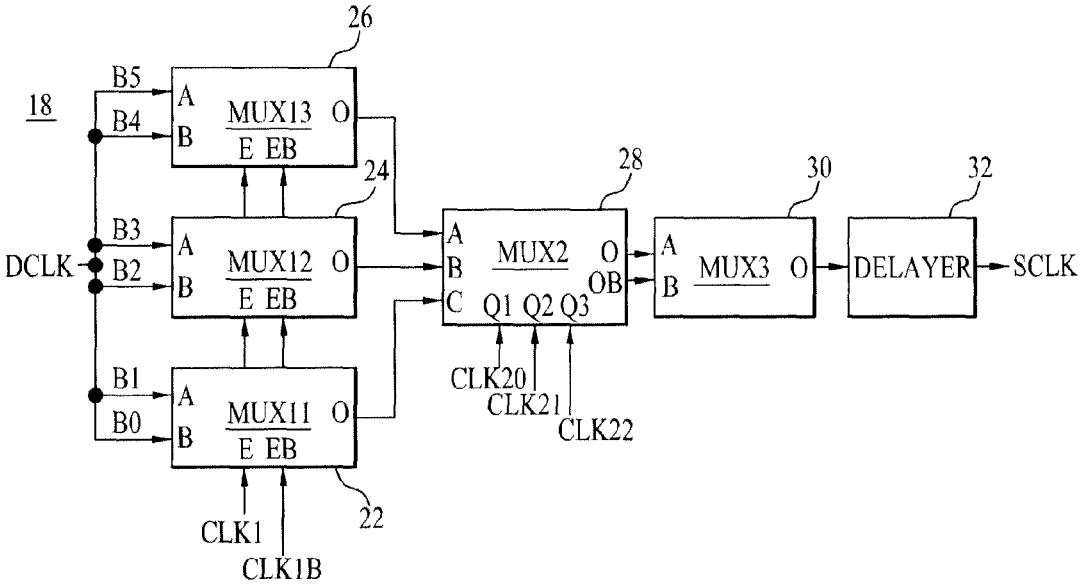
FIG. 3 is a block diagram illustrating an inner configuration of a fourth serializer shown in FIG. 2.

FIG. 3 is a block diagram specifically illustrating the fourth serializer 18 shown in FIG. 32.

The fourth serializer 18 shown in FIG. 3 includes a plurality of multiplexers (hereinafter, MUX) 22, 24, 26, 28 and 30 and a delayer 32. Here, the MUX 30 and the delayer 32 are selectable by a designer. The first to third serializers 12, 14 and 16 shown in FIG. 3 includes the same specific configuration like those shown in FIG. 3. Here, the input and output signals of the clocks (DCLK/SCLK) are replaced with the input and output of image data for each color (R/SR, G/SG or B/SG). As follows, it is premised that the first to fourth serializers 12, 14, 16 and 18 input 6-bit data for explanation convenience.

MUX11 to MUX13 (22, 24 and 26) divides and inputs each of 6-bit signals inputted in parallel into 2-bit signals. In case of the fourth serializer 18 configured to input the dot-clock (DCLK), the dot-clock (DCLK) is inputted according to the 6-bit input signals (B0~B1). Each of the MUX11 to MUX13 (22, 24 and 26) sequentially selects the parallel input 2-bit signals in response to the first clock (CLK) inputted to an enable-terminal (E) from the PLL 2 and a first reverse clock (CLK1B) inputted to an enable-reverse terminal (EB) to output, such that the 2-bit input parallel signals may be converted into 2-bit serial signals having increased frequency according to the first clock (CLK) to output.

The MUX2 (28) selects the three 2-bit serial signals outputted from the MUX11 to MUX13 (22, 24 26) in response to three second clocks (CLK20, CLK21 and CLK22) having different phases to output and it converts the three 2-bit serial signals into 6-bit serial signals having increased frequency according to the second clocks (CLK2: CLK20, CLK21, CLK22) to output.

The MUX3 (30) selects one of the serial signal outputted from an output terminal (0) of the MUX1 (28) and the reverse signal outputted from a reverse output terminal (OB) of the MUX1 (28) and it outputs the selected signal. The delayer 32 delays the serial signal outputted from the MUX3 (30) to a predetermined time period to output.

As a result, the fourth serializer 18 converts the dot-clock (DCLK) into the high speed clock (SCLK) having the increased frequency according to the first and second clocks (CLK1 and CLK2) and it outputs the converted high speed clock (SCLK). The first to third serializers 12, 14 and 16 convert the 6-bit parallel data (R, G and B) into the 6-bit serial data (SR, SG and SB) having the increased frequency according to the first and second clocks (CLK1 and CLK2) and they output the converted high speed 6-bit serial data. The high speed clock (SCLK) outputted from the fourth serializer 18 is synchronized with middle portions of the serial data (SR, SG and SB) outputted from the first to third serializers 12, 14 and 16, respectively, to output.

As mentioned above, the LVDS transmitter 10 according to the present invention converts the dot-clock (DCLK) into the high speed clock (SCLK) according to the first and second clock (CLK1 and CLK2) via the serializer 4 such as image data (R, G and B). Because of that, the timing matching between the serial data (SR, SG and SB) and the high speed clock (SCLK) may be implemented easily. At this time, the rising or falling timing of the high speed clock (SCLK) may be synchronized with the middle portions of the serial data (SR, SG and SB). Also, even if the power, voltage and temperature change because of external environments and device difference, the communication between the serial data (SR, SG and SB) and the high speed clock (SCLK) changes the timing at the same level such that timing skew of the serial data (SR, SG and SB) and the high speed clock (SCLK) may be minimized. As a result, when restoring from the received differential signal, the LVDS receiver may secure an enough timing margin between the data and the clock to restore accurate data.

Figure 4:
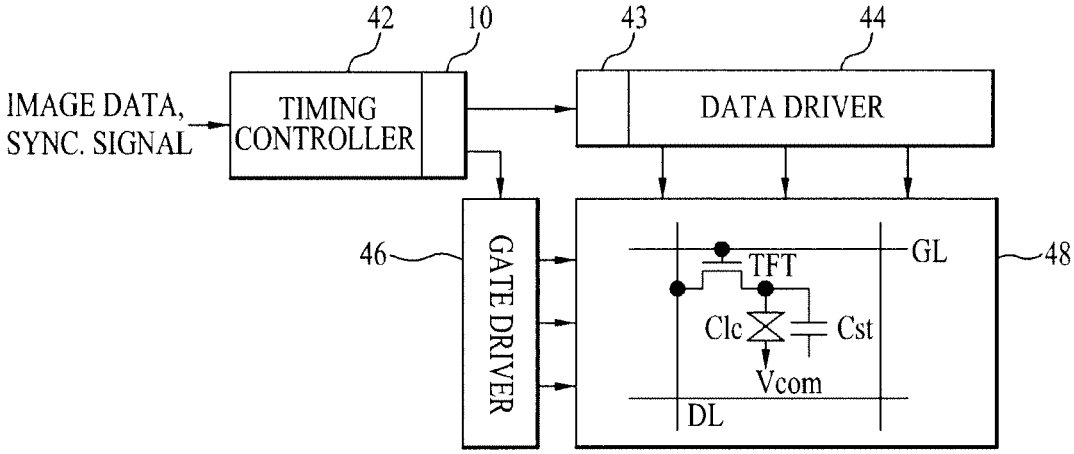
FIG. 4 is a block diagram illustrating a liquid crystal display using the data transmitting device according to the present invention.

FIG. 4 is a block view schematically illustrating a liquid crystal display using the data transmitting device according to the embodiment of the present invention.

The liquid crystal display shown in FIG. 4 includes a timing controller 42, a data driver 44, a gate driver 46 and a liquid crystal panel 48. Here, the timing controller 42 has the LVDS transmitter 10 shown in FIGS. 1 to 3 mounted therein and the data driver 44 has the LVDS receiver mounted therein, such that data may be transmitted based on mini-LVDS.

The timing controller 42 makes video data inputted outside in alignment and it outputs the aligned input video data to the data driver 44. In addition, the timing controller 42 generates a data control signal controlling a driving timing of the data driver 44 and a gate control signal controlling a driving timing of the gate driver 46, using synchronizing signals including vertical synchronizing signals and horizontal synchronizing signals, data enable signals, dot clocks, only to output the data control signal and the gate control signal to the data driver 44 and the data driver 46, respectively. Especially, the timing controller 43 has the LVDS transmitter 10 shown in FIGS. 1 to 3 mounted in an output terminal thereof to the slow speed parallel image data (R, G and B) and the dot-clock (DCLK) into the high speed serial image data (SR, SG and SB) and the high speed clock (SCLK), respectively, and to converted them into the low voltage differential signals (LR, LG, LB and LCLK) which will be outputted to the data driver 44. The timing controller 42 converts a data control signal and a gate control signal into differential signals to output converted differential signals to the data driver 44 and the gate driver 46, respectively. As mentioned in FIGS. 1 and 3, the dot-clock (DCLK) is converted into the high speed clock (SCLK) according to the first and second clock (SCL1 and CLK2) via the serializer 4 such as the image data (R, G and B). because of that, even if conditions including the power, voltage and temperature change, timing skew between the serial data (SR, SG and SB) and the high speed clock (SCLK) may be minimized.

The data driver 44 has the LVDS receiver 43 mounted in an input terminal thereof and it restores the serial image data and the high speed clock according to the voltage difference of the differential signals (LR, LG, LB and LCLK) received from the timing controller 42. After that, the data driver 44 converts the restored serial image data and the high speed clock into parallel data and dot-clock. The LVDS receiver 43 restores a data control signal from the differential signal received from the timing controller 42 to output. The data driver 44 converts digital image data outputted from the timing controller 44 into an analog data signal, in other words, pixel voltage signal using a gamma voltage in response to the data control signal of the timing controller 42 and it supplies the analog data signal to data line (DL) of the liquid crystal panel 48.

The gate driver 26 sequentially drives gate lines (GL) of the liquid crystal panel 48 in response to the data control signal outputted from the timing controller 42.

The liquid crystal panel 48 displays images via a pixel matrix having plural pixels aligned therein. Each of the pixels represents a desired color combined with red, green and blue sub-pixels adjusting light transmissivity based on variety of liquid crystal alignment according to a brightness-compensated data signal. Each of the sub-pixels includes a thin film transistor (TFT) connected with the gate lines (GL) and the data lines (DL), a liquid crystal capacitor (C1c) connected with the TFT in parallel and a storage capacitor (Cst). The liquid crystal capacitor (C1c) charges a voltage difference between the data signal supplied to the pixel electrode via the TFT and the common voltage (Vcom) supplied to the common electrode and it drives the liquid crystal according to the charged voltage to control light transmissivity. The storage capacitor (Cst) keeps the voltage charged by the liquid capacitor (C1c) stably. As a result, the liquid crystal panel 48 displays images according to the data signals by using the lights from a backlight unit (not shown).

According to the present invention, there are following advantageous effects.

First of all, according to the data transmitting device and the flat plate display using the same, clock frequency is converted via the sterilizer such as data. Because of that, even if the power, voltage and temperature change, the clock timing changes in communication with data and timing skew between the data and the clocks may be reduced as much as possible accordingly. Because of that, when data is restored, a timing margin may be secured enough to restore accurate data.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A data transmitting device comprising:

a clock generator configured to generate and output a first clock by using oscillation according to an input reference clock and to generate a plurality of second clocks having different phases, by multiplying frequency of the first clock and separating a phase of the multiplied first clock;

a serializer configured to convert parallel image data and a dot clock inputted at a slow speed into high speed serial data and high speed clock according to the first and second clocks outputted from the clock generator and to output the high speed serial image data and the high speed clock; and a signal converter configured to convert the serial image data and the high speed clock outputted from the serializer into differential signals and to output the differential signals.

2. The data transmitting device of claim 1, wherein the serializer comprises, first to third serializers configured to convert the parallel image data into the serial image data by color unit according to the first and second clocks; and a fourth serializer configured to convert the dot-clock into the high speed clock according to the first and second clocks.

3. The data transmitting device of claim 2, wherein each of the first to fourth serializers comprises, a plurality of first multiplexers configured to multiplex a n-bit input signal by m(n>m) bit unit in response to the first clock and to convert the n-bit input signal into a plurality of m-bit serial signals; and a second multiplexer configured to convert the plurality of the m-bit serial signals into n-bit serial signals, wherein each of the dot-clocks is commonly inputted in the fourth serializer at each of bits of the n-bit input signals.

4. The data transmitting device of claim 2, wherein each of the first to fourth serializers further comprises a delayer configured to delay a timing of serial signals outputted from the second multiplexer.

5. The data transmitting device of claim 1, wherein the clock generator comprises, a phase locked loop (PLL) configured to generate and output the first clock having a higher speed than the reference clock according to oscillation using the input reference clock; and a ring counter configured to generate and output the plurality of the second clocks having a higher speed than the first clock by multiplying frequency of the first clock and separating a phase of the first clock.

6. The data transmitting device of claim 1, wherein the high speed clock is synchronized with a middle portion of the serial image data to be outputted.

7. A flat plate display comprising, the flat plate display comprising:

a timing controller configured to convert image data and a dot-clock into differential signals and to output the differential signals; and a data driver configured to receive the differential signals from the timing controller and to restore the image data and the dot-clock from the received differential signals to supply the restored image data and dot-clock to a display panel;

wherein the timing controller includes a data transmitter comprising:

a clock generator configured to generate and output a first clock by using oscillation according to an input reference clock and to generate a plurality of second clocks having different phases, by multiplying frequency of the first clock and separating a phase of the multiplied first clock;

a serializer configured to convert parallel image data and the dot clock inputted at a slow speed into high speed serial data and high speed clock according to the first and second clocks outputted from the clock generator and to output the high speed serial image data and the high speed clock; and a signal converter configured to convert the serial image data and the high speed clock outputted from the serializer into differential signals and to output the differential signals.

8. The flat plate display of claim 7, wherein the serializer comprises, first to third serializers configured to convert the parallel image data into the serial image data by color unit according to the first and second clocks; and a fourth serializer configured to convert the dot-clock into the high speed clock according to the first and second clocks.

9. The flat plate display of claim 8, wherein each of the first to fourth serializers comprises, a plurality of first multiplexers configured to multiplex a n-bit input signal by m(n>m) bit unit in response to the first clock and to convert the n-bit input signal into a plurality of m-bit serial signals; and a second multiplexer configured to convert the plurality of the m-bit serial signals into n-bit serial signals, wherein each of the dot-clocks is commonly inputted in the fourth serializer at each of bits of the n-bit input signals.

10. The flat plate display of claim 8, wherein each of the first to fourth serializers further comprises a delayer configured to delay a timing of serial signals outputted from the second multiplexer.

11. The flat plate display of claim 7, wherein the clock generator comprises, a phase locked loop (PLL) configured to generate and output the first clock having a higher speed than the reference clock according to oscillation using the input reference clock; and a ring counter configured to generate and output the plurality of the second clocks having a higher speed than the first clock by multiplying frequency of the first clock and separating a phase of the first clock.

12. The flat plate display of claim 7, wherein the high speed clock is synchronized with a middle portion of the serial image data to be outputted.

13. The flat plate display of claim 7, wherein the flat plate display is a liquid crystal display.

* * * * *